US009585498B1

(12) United States Patent
Borden

(10) Patent No.: US 9,585,498 B1
(45) Date of Patent: Mar. 7, 2017

(54) PROSTHETIC SLEEVE HOLDING APPARATUS

(71) Applicant: Jesse C. Borden, Olathe, KS (US)

(72) Inventor: Jesse C. Borden, Olathe, KS (US)

( * ) Notice: Subject to any disclaimer, the term of this patent is extended or adjusted under 35 U.S.C. 154(b) by 0 days.

(21) Appl. No.: 14/922,378

(22) Filed: Oct. 26, 2015

(51) Int. Cl.

| | |
|---|---|
| ***A47F 5/02*** | (2006.01) |
| ***A47B 81/00*** | (2006.01) |
| ***A47B 49/00*** | (2006.01) |
| ***F26B 25/18*** | (2006.01) |
| ***D06F 59/00*** | (2006.01) |
| ***A47L 23/20*** | (2006.01) |

(52) U.S. Cl.
CPC ..... *A47F 5/02* (2013.01); *A47B 49/00* (2013.01); *A47B 81/00* (2013.01); *A47L 23/20* (2013.01); *D06F 59/00* (2013.01); *F26B 25/18* (2013.01)

(58) Field of Classification Search
CPC ..... A61B 50/22; A61B 50/24; A47G 25/20; A47F 7/08; A47F 5/10; A47F 7/17; A47F 7/175; A47F 5/02; A47F 7/007; A47F 7/141; A47F 5/04; A47F 2009/004; A47B 61/02; A47B 45/00; A47B 49/00; A47B 81/00; A47B 47/00; A61F 2002/7837; A61F 2002/7818; A61F 2/7812; F26B 25/18; F26B 25/185; F26B 13/102; D06F 57/00; D06F 59/02; D06F 59/04; D06F 59/06; D06F 59/00; A47L 23/20
USPC .... 211/85.13, 85.5, 30, 34, 37, 38, 49.1, 44, 211/12, 85.15, 175, 196, 205, 163, 70, 77, 211/58; 248/349.1; 108/139; 34/239, 34/240, 104
See application file for complete search history.

(56) References Cited

U.S. PATENT DOCUMENTS

| | | | | | |
|---|---|---|---|---|---|
| 1,583,784 | A | | 5/1926 | Erickson | |
| 2,526,245 | A | * | 10/1950 | Lathrop | A47B 49/00 108/139 |
| 2,600,922 | A | * | 6/1952 | Rodolfa | A47G 23/08 108/139 |
| 2,970,701 | A | | 2/1961 | Fetteer | |
| 3,478,890 | A | | 11/1969 | Allsop | |
| 3,513,564 | A | * | 5/1970 | Gramprie | A47K 10/06 34/104 |
| 4,036,367 | A | | 7/1977 | Stambaugh et al. | |
| 4,304,166 | A | | 12/1981 | Stefano et al. | |
| 4,418,434 | A | * | 12/1983 | Joh | A43D 3/1416 12/128 B |
| 4,635,894 | A | * | 1/1987 | Sammons | A47B 49/00 108/103 |

(Continued)

*Primary Examiner* — Daniel J Troy
*Assistant Examiner* — Hiwot Tefera
(74) *Attorney, Agent, or Firm* — Dale J. Ream

(57) ABSTRACT

A prosthetic sleeve holding apparatus for holding at least one prosthetic sleeve includes a base member including opposed top and bottom surfaces having a generally planar configuration, the base member including a first guide ring positioned on the top surface. A support member is rotatably coupled to the base member, the support member having upper and lower surfaces and a circular configuration for rotation about an imaginary vertical axis of rotation. The support member includes a second guide ring situated on the lower surface of the support member. A pair of spaced apart support rods extends upwardly from the support member, each support rod having a cylindrical configuration and a free end displaced from the base member and that is configured to support the prosthetic sleeve.

14 Claims, 13 Drawing Sheets

(56) References Cited

U.S. PATENT DOCUMENTS 4,934,766 A 6/1990 Schmidt et al.
5,031,779 A * 7/1991 Szenay ..... A47F 5/02 211/163
5,379,885 A * 1/1995 Chen ..... B25H 3/06 206/216
5,394,619 A * 3/1995 Kaplan ..... D06F 57/127 34/104
5,406,717 A * 4/1995 Dofka ..... F26B 21/008 211/37
5,549,506 A 8/1996 Higa et al.
5,604,993 A * 2/1997 Auckerman ..... D06F 59/04 219/211
6,327,792 B1 * 12/2001 Hebert ..... A43D 3/1491 34/104
6,499,230 B1 * 12/2002 Fix ..... F26B 9/003 34/107
6,641,340 B1 11/2003 Hajjar et al.
6,779,671 B2 * 8/2004 Varga ..... B65F 1/141 211/163
7,814,677 B2 * 10/2010 Brewer ..... A45D 20/12 132/271
8,857,072 B1 * 10/2014 Cocker ..... F26B 9/003 34/103
8,955,234 B2 * 2/2015 Williams ..... A47L 23/205 211/85.7
2003/0015486 A1 * 1/2003 Chen ..... A47F 5/02 211/70
2010/0023019 A1 1/2010 Fuhrer et al.
2011/0094983 A1 4/2011 Burnside-Hall
2013/0037503 A1 * 2/2013 Cimino ..... A47G 25/0664 211/85.3
2013/0087516 A1 4/2013 Kowalewski et al.
2013/0284685 A1 * 10/2013 Lines-Pinckney ..... A47H 1/022 211/105.3
2015/0337988 A1 * 11/2015 Huang ..... F16L 1/14 405/184.4

* cited by examiner

PROSTHETIC SLEEVE HOLDING APPARATUS

BACKGROUND OF THE INVENTION

This invention relates generally to prosthetic device accessories and, more particularly, to a holding apparatus specifically configured to hold a prosthetic sleeve or liner in a vertically suspended and rotatable configuration.

A person having a prosthetic limb, such as a prosthetic leg or arm, typically wear a sleeve (also referred to as a liner or sock) over the stump of their natural limb before inserting their remaining limb into the prosthesis socket. Then, at the end of the day, such as at bedtime, the person removes the prosthetic limb and the sleeve. It may be desirable to spread out the sleeve or hang it so that it can air out or dry before being used again the next morning.

Various devices have been proposed in the art for holding or suspending devices such as musical instruments, tools, and the like. Although presumably effective for their intended purposes, the existing devices are not suitable for supporting prosthetic liners or sleeves in a manner that allows for sufficient ventilation or drying and which also is convenient for rotating a fresh sleeve into position to be used next while the newly suspended sleeve remains in a support configuration.

Therefore, it would be desirable to have a prosthetic sleeve holding apparatus having a support member that is rotatable on demand relative to a base member and having at least a pair of support rods extending upwardly from the support member, each support rod being configured to support a prosthetic sleeve in an elevated position. Further, it would be desirable to have a prosthetic sleeve holding apparatus in which a pair of support is rotatable by a user so that a more recently used sleeve may be rotated away and a less recently used sleeve may be removed for use.

SUMMARY OF THE INVENTION

A prosthetic sleeve holding apparatus for holding at least one prosthetic sleeve according to the present invention includes a base member including opposed top and bottom surfaces having a generally planar configuration, the base member including a first guide ring positioned on the top surface. A support member is rotatably coupled to the base member, the support member having upper and lower surfaces and a circular configuration for rotation about an imaginary vertical axis of rotation. The support member includes a second guide ring situated on the lower surface of the support member. A pair of spaced apart support rods extends upwardly from the support member, each support rod having a cylindrical configuration and a free end displaced from the base member and that is configured to support the prosthetic sleeve.

Therefore, a general object of this invention is to provide a holding apparatus for holding at least one prosthetic sleeve in a convenient vertical elevated position easily accessible to a person when removing the sleeve from his leg or putting it on.

Another object of this invention is to provide a prosthetic sleeve holding apparatus, as aforesaid, having a pair of upstanding support rods each having a free end configured to receive and support a pair of prosthetic sleeves, respectively, in an elevated and spaced apart position.

Still another object of this invention is to provide a prosthetic sleeve holding apparatus, as aforesaid, which may be rotated so that a most recently used sleeve may be moved away from a user's position and a less recently used sleeve may be moved closer to the user.

Yet another object of this invention is to provide a prosthetic sleeve holding apparatus, as aforesaid, having a support member rotatably coupled to a fixed base member, the support rods extending upwardly from the rotatable support member.

A further object of this invention is to provide a prosthetic sleeve holding apparatus, as aforesaid, in which the support rods, in an embodiment, include a desiccant humidifier configured to absorb moisture and odor from a sleeve supported by a respective support rod.

A still further object of this invention is to provide a prosthetic sleeve holding apparatus, as aforesaid, that is easy to use, inexpensive to manufacture, and provides convenience to a person having a prosthetic limb.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
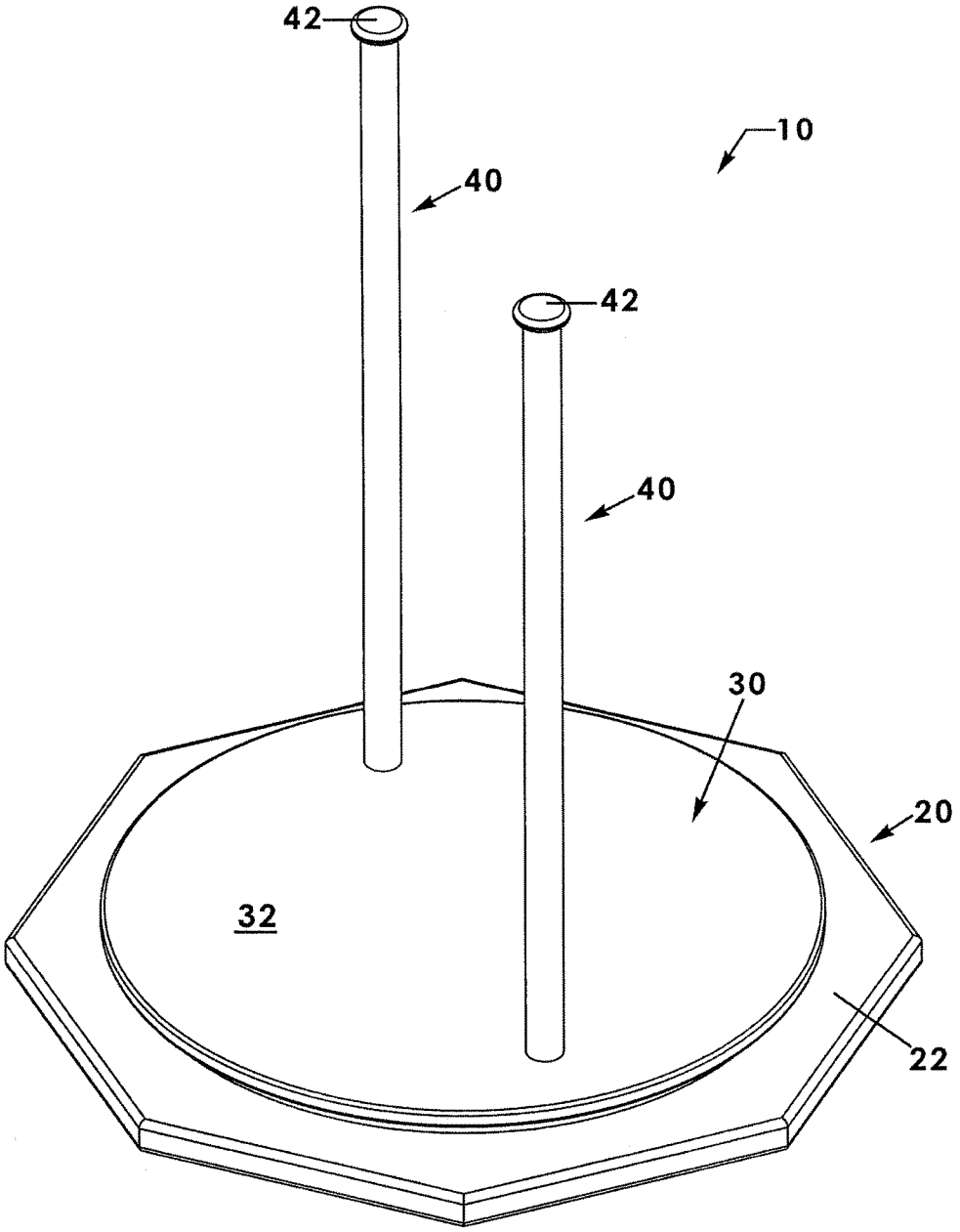
FIG. 1 is a perspective view of a prosthetic sleeve holding apparatus according to a preferred embodiment of the present invention.
Figure 2:
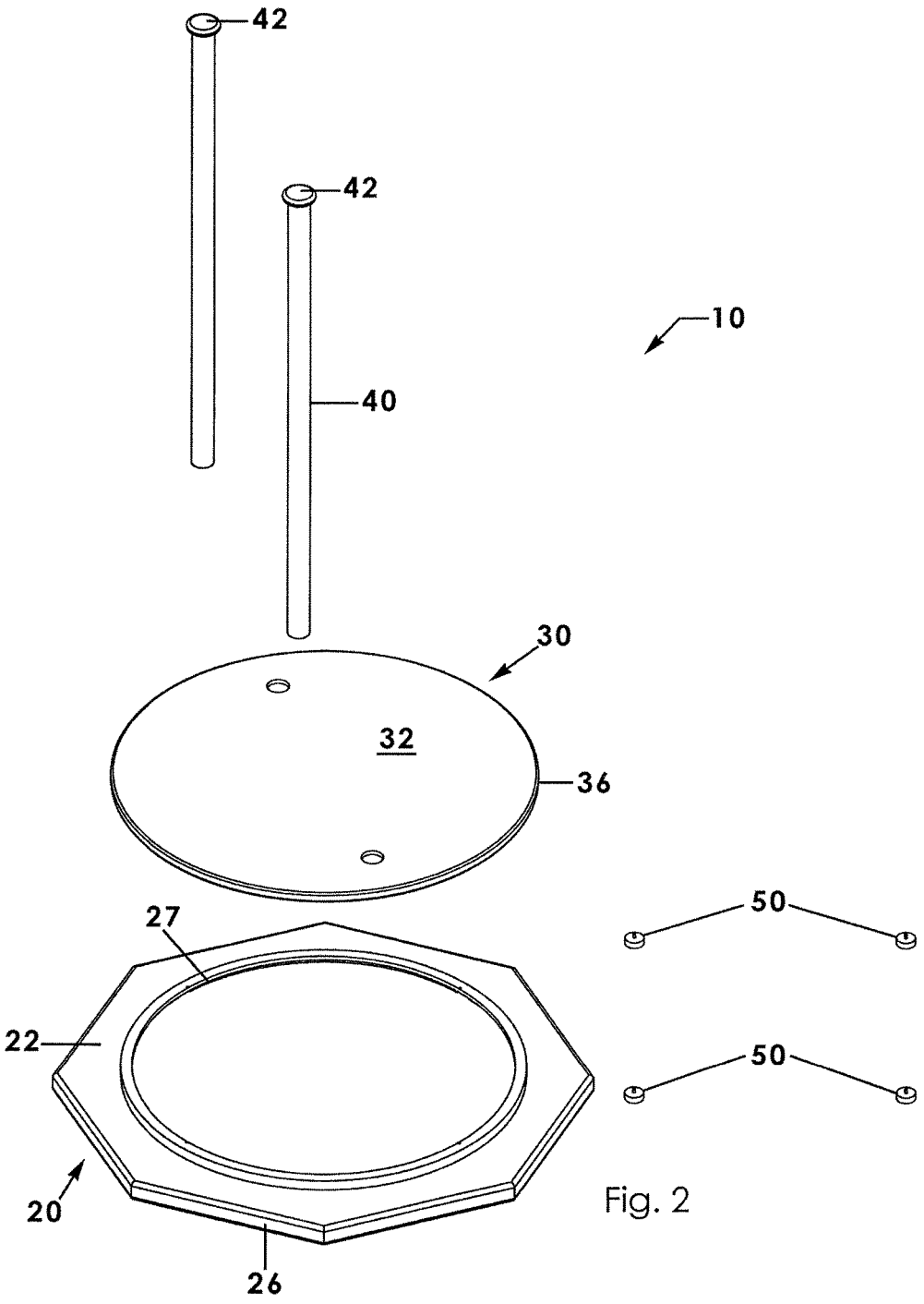
FIG. 2 is an exploded view of the holding apparatus as in FIG. 1.
Figure 3:
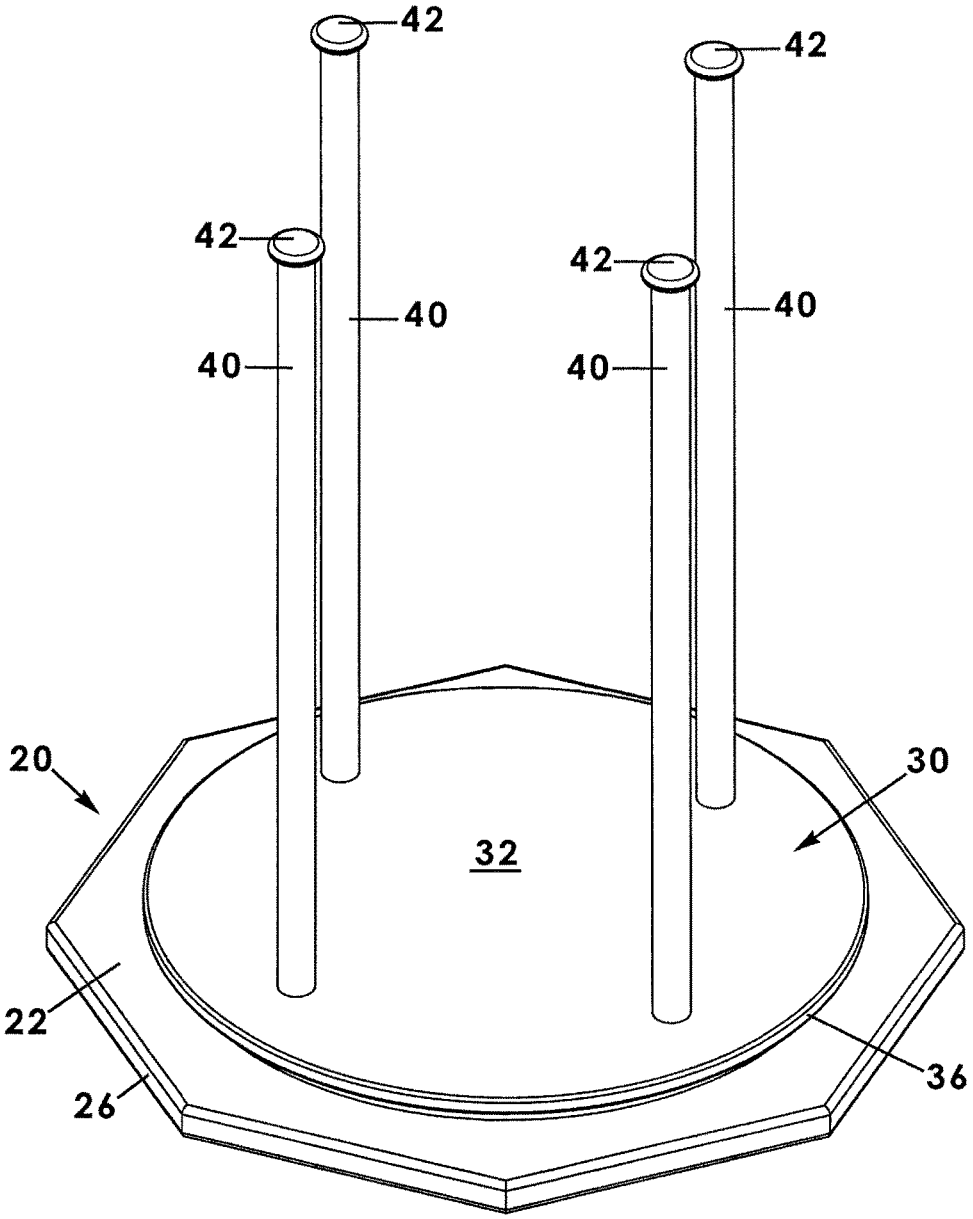
FIG. 3 is another perspective view of the holding apparatus as in FIG. 1, illustrated with four support rods.
Figure 4:
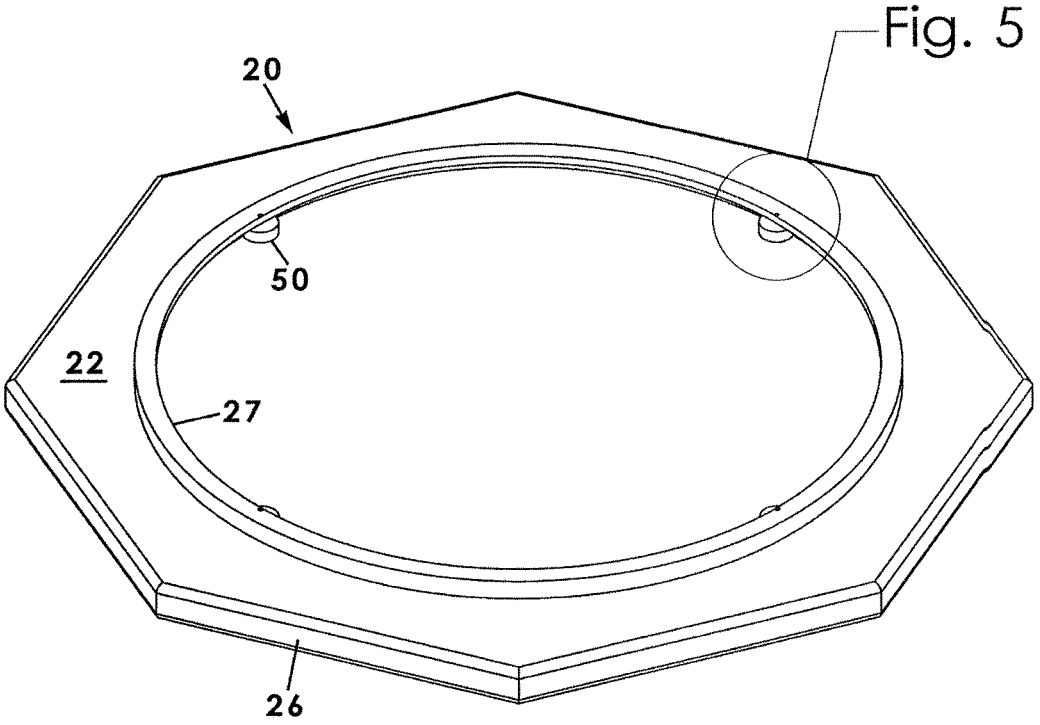
FIG. 4 is a perspective view of a base member of the holding apparatus removed from the assembly as in FIG. 1.
Figure 5:
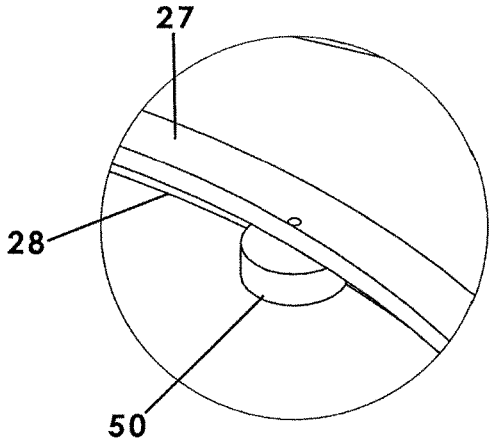
FIG. 5 is an isolated view on an enlarged scale taken from FIG. 4.
Figure 6:
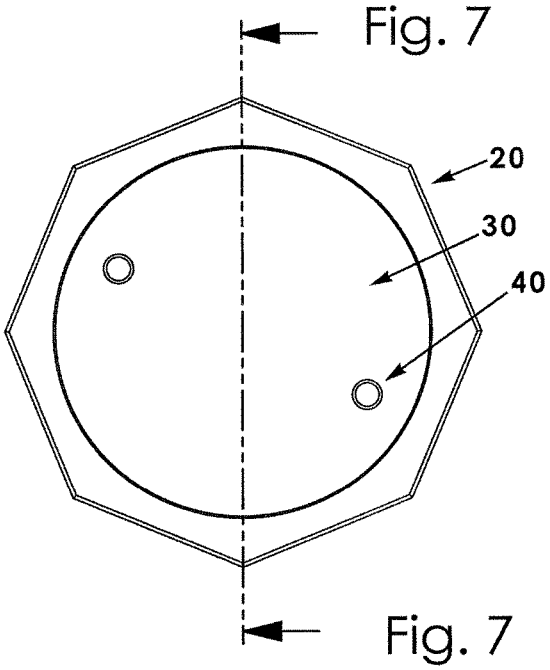
FIG. 6 is a top view of the holding apparatus as in FIG. 1.
Figure 7:
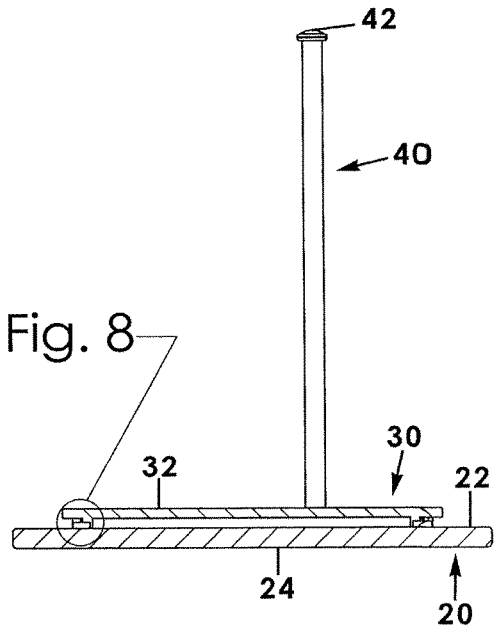
FIG. 7 is sectional view taken along line 7-7 of FIG. 6.
Figure 8:
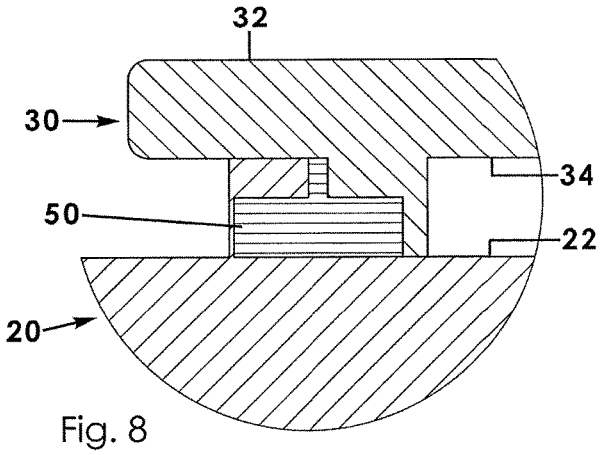
FIG. 8 is an isolated view on an enlarged scale taken from FIG. 7.
Figure 9A:
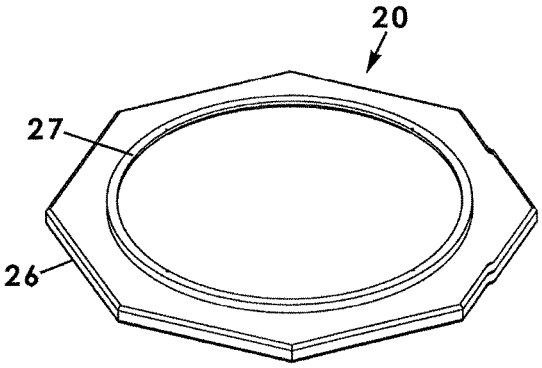
FIG. 9*a* is a perspective view of a base member of the holding apparatus removed from the assembly as in FIG. 1.
Figure 9B:
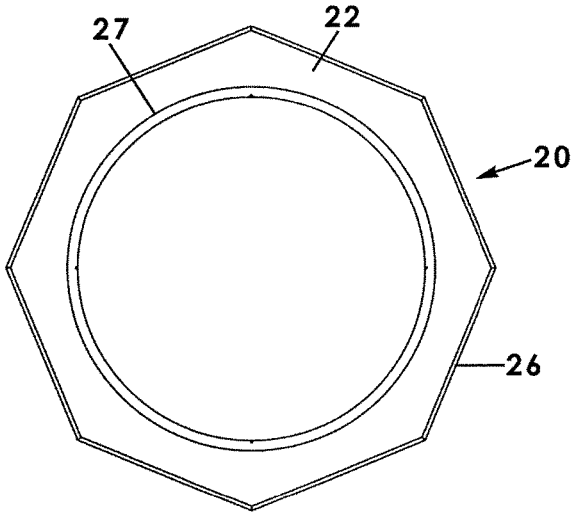
FIG. 9*b* is a top view of the base member as in FIG. 9*a;*
Figure 9C:
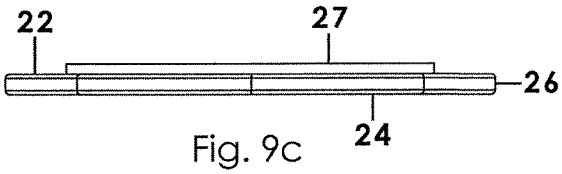
FIG. 9*c* is a side view of the base member as in FIG. 9*b;*
Figure 10A:
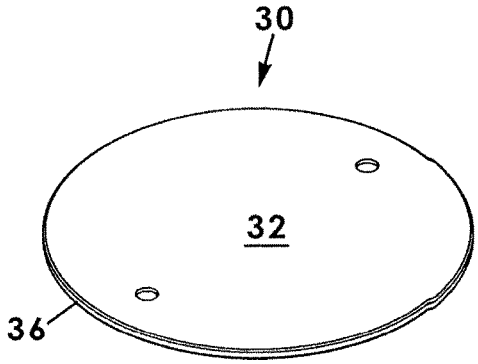
FIG. 10*a* is a perspective view of a support member of the holding apparatus removed from the assembly as in FIG. 1.
Figure 10B:
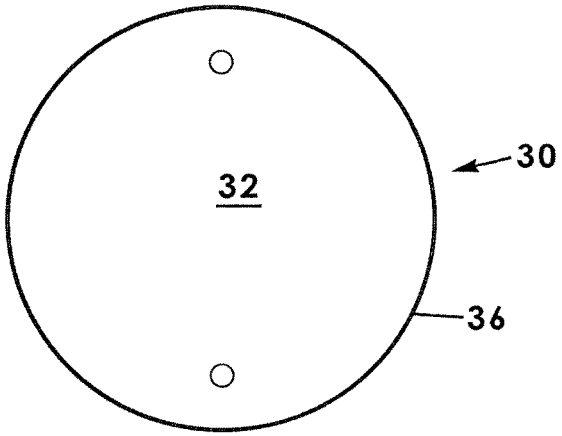
FIG. 10*b* is a top view of the support member as in FIG. 10*a;*
Figure 10C:
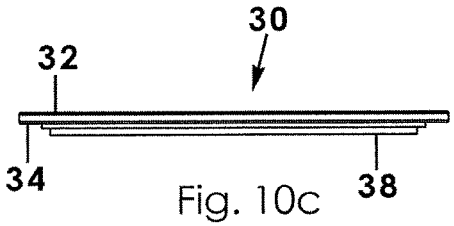
FIG. 10*c* is a side view of the support member as in FIG. 10*b;*
Figure 11A:
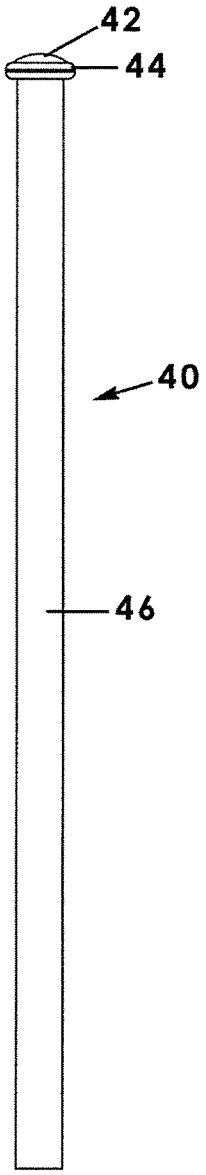
FIG. 11*a* is a side view of a support rod removed from the assembly of FIG. 1.
Figure 11B:
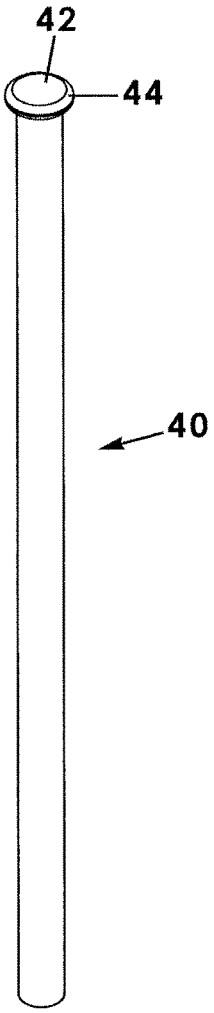
FIG. 11*b* is a perspective view of the support rod as in FIG. 11*a;*
Figure 12A:
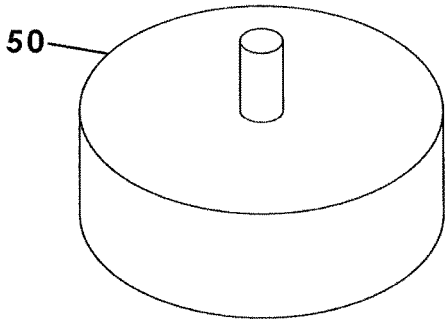
FIG. 12*a* is an enlarged perspective view of a wheel taken from FIG. 2.
Figure 12B:
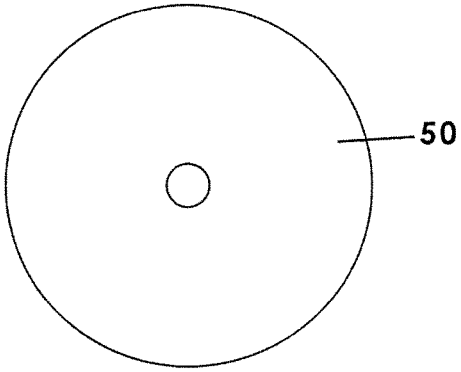
FIG. 12*b* is a top view of the wheel illustrated in FIG. 12*a;*
Figure 12C:
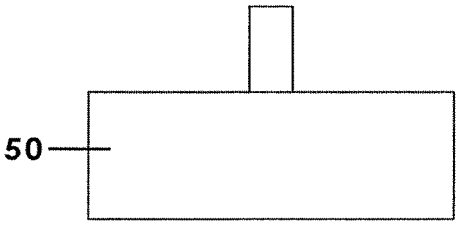
FIG. 12*c* is a side view of the wheel illustrated in FIG. 12*a;*
Figure 13A:
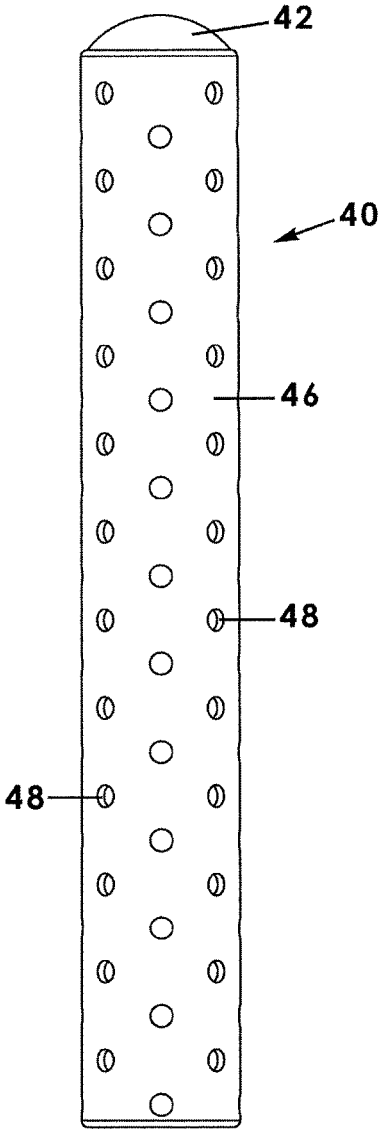
FIG. 13*a* is a side view of a support rod having a plurality of ventilation holes.
Figure 13B:
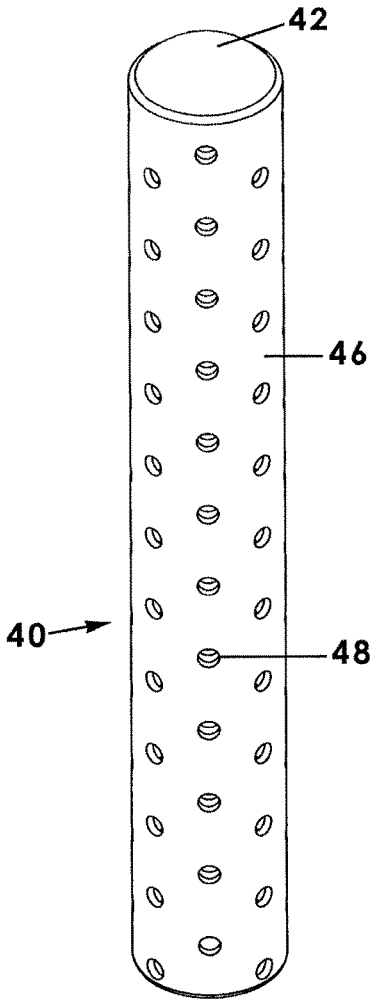
FIG. 13*b* is a perspective view of the support rod as in FIG. 13*a;*
Figure 14A:
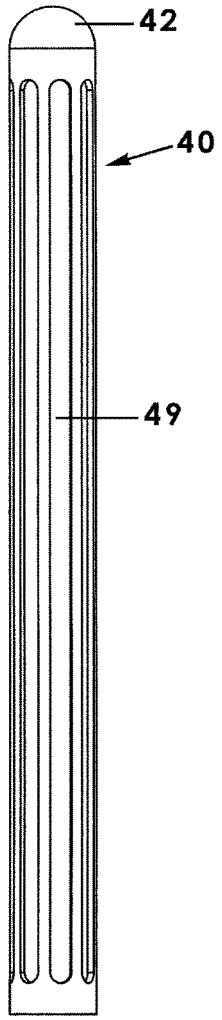
FIG. 14*a* is a side view of a support rod as in FIG. 13*a* with a side wall removed to illustrate a dehumidifier device.
Figure 14B:
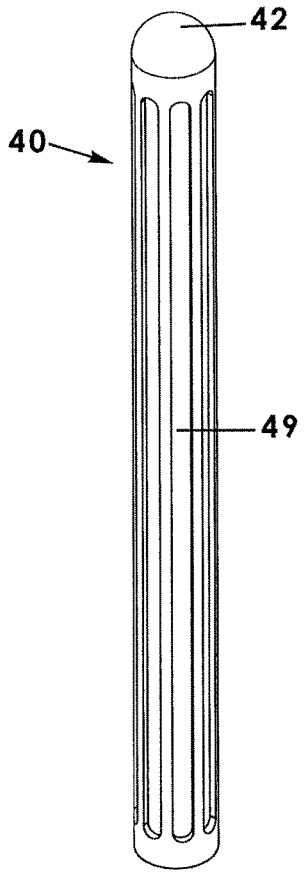
FIG. 14*b* is a perspective view of the dehumidifier device as in FIG. 14*a;*
Figure 15:
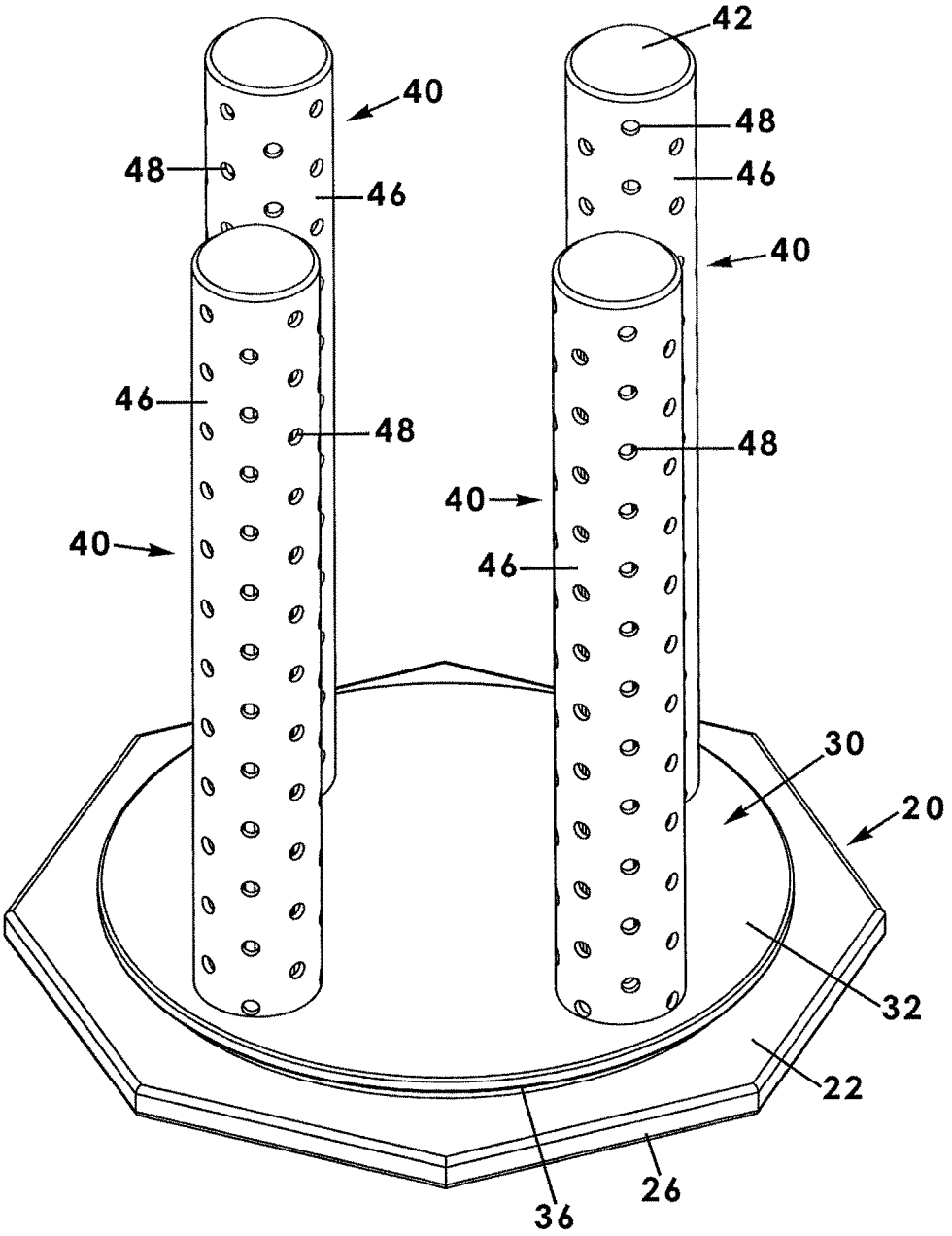
FIG. 15 is a perspective view of holding apparatus according to an embodiment of the present invention having four support rods having ventilation holes and dehumidifier elements.
Figure 16A:
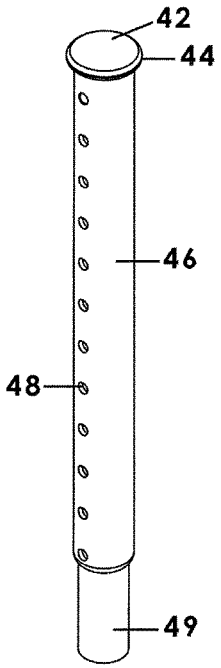
FIGS. 16*a* to 16*d* are illustrations of the holding apparatus as in FIG. 15 illustrating the side wall being removed from the support rod.
Figure 16B:
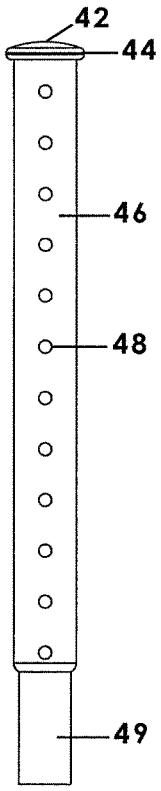
Figure 16C:
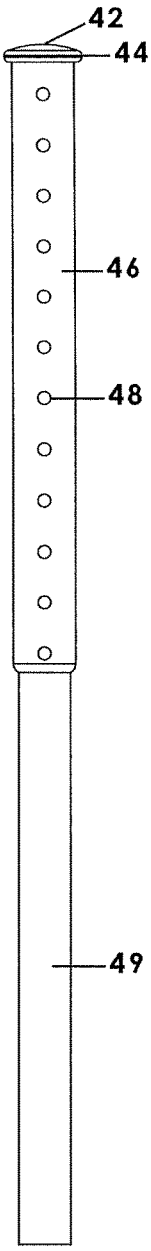
Figure 16D:
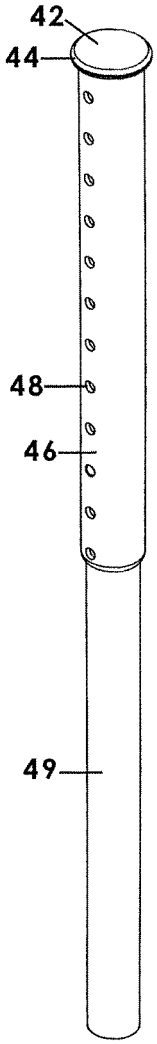

A holding apparatus for supporting a prosthetic sleeve when removed from a person's amputated appendage, such as for storage overnight, according to a preferred embodiment of the present invention will now be described with reference to FIGS. 1 to 16*c* of the accompanying drawings. The prosthetic sleeve holding apparatus 10 includes a base member 20, a support member 30 rotatably coupled to the base member 20, and at least a pair of upstanding support rods 40 configured to support a prosthetic sleeve (not shown).

The base member 20 includes opposed top 22 and bottom 24 surfaces that each have a substantially planar or flat configuration. The bottom surface 24 is configured to support the holding apparatus 10 with stability on a floor surface, such as in a residence, preferably in a bedroom where a disabled person puts on or takes off a prosthesis including a sleeve or liner (not shown). The base member 20 may be constructed of a strong and durable plastic material but may also be constructed or wood or metal. The base member 20 may have a circular configuration, or may be octagonal, hexagonal, or rectangular for stability or aesthetic reasons.

A first guide ring 27 is situated atop the top surface 22 of the base member 20. The first guide ring 27 has a circular configuration and extends upwardly/vertically a short distance so as to engage a support member 30 in a rotational engagement as will be described below. The first guide ring 27 has a small width such that the first guide ring 27 forms a short, circular wall that is inwardly displaced from a peripheral edge 26 of the base member 20. To the extent the base member 20 has a generally circular configuration, the first guide ring 27 is viewed as being inwardly concentric with the peripheral edge 26. The first guide ring 27 may be coupled to the top surface with glue or other fasteners or may be of a singular construction altogether.

The sleeve holding apparatus 10 includes a support member 30 rotatably coupled to the top surface 22 of the base member 20. The support member 30 includes upper 32 and lower 34 surfaces each having a planar configuration. Preferably, the support member 30 has a generally circular configuration although it may have a configuration that is consistent with that of the base member 20 for aesthetic reasons. Further, the support member 30 has a diameter that is smaller than a diameter of the base member 20 so that it does not come into contact with the environment surrounding the base member 20 when positioned in a room of a user's residence. The support member defines an imaginary vertical axis about which it rotates.

A second guide ring 38 is mounted to the lower surface 34 of the support member 30 and extends downwardly therefrom, the second guide ring 38 being inwardly displaced from an outer edge 36 of the support member 30. The second guide ring 38 has a circular configuration concentric to the outer edge 36 of the support member 30 and has a diameter slightly smaller than the diameter of the first guide ring 27 of the base member 20. The second guide ring 38 has a narrow width and essentially forms a short wall. The second guide ring 38 may be coupled to the top surface with glue or other fasteners or may be of a singular construction altogether. The support member 30 has a diameter larger than a diameter of the second guide ring 38 such that the second guide ring 38 and its engagement with the first guide ring 27 is hidden from view when the support member 30 is rotationally mounted atop the base member 20. Accordingly the first and second guide rings are adjacent one another and enable a rotational engagement so that the support member 30 is able to rotate by action of a user, as will be described below in more detail.

A plurality of wheels 50 is rotatably coupled to the top surface 22 of the base member 20 adjacent the first guide ring 27 and configured to rotate when contacted by rotation of the second guide ring 38 of the support member 30. Respective wheels 50 are spaced apart from one another and positioned to be engaged by the second guide ring 38 and not to block movement of the support member 30. More particularly, the first guide ring 27 atop the base member 20 defines a channel 28 that is cutout of an inner surface of the first guide ring 27, the channel 28 extending along an entirety of the circular first guide ring 27. Respective wheels 50 are partially positioned in the channel 28 and extend partially outside the channel 28. Each wheel 50 may be rotatably coupled to a top wall of the first guide channel 28 (FIG. 5*b*). Accordingly, the plurality of wheels 50 enhances a smooth rotation of the support member 30 that rotationally engages the wheels 50.

In another aspect of the invention, a plurality of support rods 40 extend upwardly from the top surface 22 of the support member 30, the support rods 40 being opposed and spaced apart from one another and inwardly displaced from the outer edge 36 of the support member 30. Each support rod 40 may include a cylindrical configuration and have a free end 42 displaced from the top surface 22 of the base member 20. The free end 42 of each support rod 40 may have a spreader flange 44 extending away from the guide rod 40 and having a domed configuration that is configured to support a prosthetic sleeve. An open end of the prosthetic sleeve may be pulled over the free end 42 of a respective rod 40 until the closed end thereof rests atop the spreader flange 44 at the free end 42 of the rod 40.

In an embodiment, there may be a pair of support rods 40. However, in other embodiments, there may be three, four, or even more support rods 40 for holding multiple prosthetic sleeves. In another embodiment, one or more support rods 40 may include a construction that is configured to absorb moisture out of prosthetic sleeve while draped over a respective free end 42. More particularly, a respective support rod 40 includes a continuous side wall 46 (i.e. a cylindrical side wall) that, together with the free end 42, define an interior area. The side wall 46 may define a plurality of spaced apart ventilation holes 48 in communication with the interior area. Further, a dehumidifier 49 is situated in the interior area and configured to absorb moisture. For instance, a silica pack, desiccant container, or an elongate version of a moisture absorbing material may be utilized as the dehumidifier device. The desiccant may contain bentonite clay, silica gel, or activated carbon to absorb moisture and odors.

In use, the support member 30 may be rotatably mounted to the base member 20 and the apparatus 10 may be positioned in a person's bedroom so as to be available to support one or more prosthetic leg sleeves or liners. When a user removes his prosthetic limb and underlying sleeve, such as prior to going to bed, the sleeve may be draped over, and supported by, a respective upstanding support rod 40. It is understood that a fresh sleeve may be supported by an opposite support rod 40. Then, a user may simply rotate the support member 30 180 degrees so that the fresh sleeve is ready to access and use the next morning. This alternate daily rotation is a good way to allow a sleeve to air out or dry out for about 24 hours before a next use. The embodiment having a desiccant dehumidifier device is further useful as drying and de-odorizing a sleeve draped over a respective support rod 40.

Accordingly, having a rotational sleeve holding apparatus is a great advantage to a disabled person who is limited in mobility to store and retrieve fresh prosthetic sleeves while not wearing his prosthetic limb.

It is understood that while certain forms of this invention have been illustrated and described, it is not limited thereto except insofar as such limitations are included in the following claims and allowable functional equivalents thereof.

The invention claimed is:

1. A prosthetic sleeve holding apparatus for use in holding at least one prosthetic sleeve, comprising:

a base member having a generally planar configuration;

a support member rotatably coupled to said base member that is configured for selective rotation about an imaginary vertical axis of rotation;

a pair of spaced apart support rods extending upwardly from said support member, each support rod having a cylindrical configuration and a free end, each support rod being configured to support the prosthetic sleeve;

wherein a respective support rod includes:

a continuous side wall extending between said support member and said free end, said side wall and said free end defining an interior area and said side wall defining a plurality of spaced apart holes in communication with said interior area;

a dehumidifier situated in said interior area and configured to passively absorb moisture proximate said plurality of holes.

2. The prosthetic sleeve holding apparatus as in claim 1, wherein:

said base member includes a top surface having a planar configuration and a first guide ring positioned on said top surface;

said support member includes a lower surface and a second guide ring coupled to said lower surface;

said second guide ring includes a diameter smaller than a diameter of said first guide ring such that said first and second guide rings are concentrically configured and engaged together for rotational movement of said support member relative to said base member.

3. The prosthetic sleeve holding apparatus as in claim 2, wherein said first guide ring includes an inner surface that defines a channel thereabout; said holding apparatus including a plurality of wheels mounted in said channel and configured to engage said second guide ring.

4. The prosthetic sleeve holding apparatus as in claim 3, wherein respective wheels are positioned partially in said channel and extend partially outside of said channel.

5. The prosthetic sleeve holding apparatus as in claim 2, wherein said support member has a diameter that is larger than said diameter of said second guide ring such that said second guide ring is not visible when said support member is rotatably coupled to said base member.

6. The prosthetic sleeve holding apparatus as in claim 1, wherein said pair of support rods are positioned opposite one another and adjacent to a peripheral edge of said support member so that a 180 degree rotation of said support member relative to said base member interchanges a position of respective support rods.

7. The prosthetic sleeve holding apparatus as in claim 2, wherein:

said base member has an octagonal configuration and said first guide ring positioned thereon has a circular configuration;

said support member has a circular configuration and said second guide ring depending therefrom has a circular configuration.

8. The prosthetic sleeve holding apparatus as in claim 2, wherein each support rod includes a spreader flange positioned at said free end, said spreader flange extending away from said support rod and having a dome-shaped configuration for opening the prosthetic sleeve positioned on said respective support rod.

9. The prosthetic sleeve holding apparatus as in claim 1, further comprising a plurality of auxiliary support rods spaced apart from said pair of support rods, each auxiliary support rod extending upwardly from said top surface of said support member.

10. A prosthetic sleeve holding apparatus for holding at least one prosthetic sleeve, comprising:

a base member including opposed top and bottom surfaces having a generally planar configuration, said base member including a first guide ring positioned on said top surface;

a support member rotatably coupled to said base member, said support member having upper and lower surfaces and a circular configuration for rotation about an imaginary vertical axis of rotation;

wherein said support member includes a second guide ring situated on said lower surface of said support member;

a pair of spaced apart support rods extending upwardly from said support member, each support rod having a cylindrical configuration and a free end displaced from said base member and that is configured to support the prosthetic sleeve;

wherein a respective support rod includes:

a continuous side wall extending between said support member and said free end, said side wall and said free end defining an interior area and said side wall defining a plurality of spaced apart holes in communication with said interior area;

a dehumidifier situated in said interior area and configured to absorb moisture proximate said plurality of holes;

wherein said dehumidifier is taken from a group consisting of a silicon pack, a desiccant container, bentonite clay, silica gel, and activated carbon.

11. The prosthetic sleeve holding apparatus as in claim 10, wherein said second guide ring includes a diameter smaller than a diameter of said first guide ring such that said first and second guide rings are configured concentrically and engaged together for rotational movement of said support member relative to said base member.

12. The prosthetic sleeve holding apparatus as in claim 11, further comprising a plurality of wheels operatively coupled to said first guide ring, wherein:

said first guide ring includes an inner surface that defines a channel thereabout, said plurality of wheels being operatively coupled to said first guide ring and situated in said channel;

respective wheels are positioned partially in said channel and extend partially outside of said channel and are rotatably engaged by said support member when rotatably coupled to said base member.

13. The prosthetic sleeve holding apparatus as in claim 10, wherein said support member has a diameter that is larger than said diameter of said second guide ring such that said second guide ring is not visible when said support member is rotatably coupled to said base member.

14. The prosthetic sleeve holding apparatus as in claim 10, wherein each support rod includes a spreader flange positioned at said free end, said spreader flange extending away from said support rod and having a dome-shaped configuration for opening the prosthetic sleeve positioned on said respective support rod.

* * * * *